US006517366B2

(12) United States Patent
Bertini et al.

(10) Patent No.: US 6,517,366 B2
(45) Date of Patent: Feb. 11, 2003

(54) METHOD AND APPARATUS FOR BLOCKING PATHWAYS BETWEEN A POWER CABLE AND THE ENVIRONMENT

(75) Inventors: Glen J. Bertini, Tacoma, WA (US); William R. Stagi, Seattle, WA (US)

(73) Assignee: Utilx Corporation, Kent, WA (US)

( * ) Notice: Subject to any disclaimer, the term of this patent is extended or adjusted under 35 U.S.C. 154(b) by 0 days.

(21) Appl. No.: 10/013,940

(22) Filed: Dec. 6, 2001

(65) Prior Publication Data

US 2002/0102876 A1 Aug. 1, 2002

Related U.S. Application Data

(60) Provisional application No. 60/251,974, filed on Dec. 6, 2000.

(51) Int. Cl.[7] ..... H01R 4/60

(52) U.S. Cl. ..... 439/190; 439/201; 439/921

(58) Field of Search ..... 439/190, 88, 912, 439/921, 89, 206, 181, 183, 184, 185, 191, 198, 936, 934, 933, 199–205; 222/380; 137/539; 239/525, 526; 184/105.2, 105.3

(56) References Cited

U.S. PATENT DOCUMENTS

| | | | | |
|---|---|---|---|---|
| 1,846,361 A | | 2/1932 | Saylor | 174/85.6 |
| 2,248,588 A | | 7/1941 | Shanklin et al. | 174/21 R |
| 3,649,952 A | | 3/1972 | Harmon | 439/158 |
| 3,791,406 A | * | 2/1974 | Philipps | 137/515.5 |
| 3,883,208 A | | 5/1975 | Sankey et al. | 439/101 |
| 4,077,494 A | * | 3/1978 | Spaude et al. | 184/105 A |
| 4,202,591 A | | 5/1980 | Borgstrom | 439/185 |
| 4,545,133 A | | 10/1985 | Fryszczyn et al. | 34/21 |
| 4,669,792 A | * | 6/1987 | Kjeldstad | 439/38 |
| 4,888,886 A | | 12/1989 | Eager, Jr. et al. | 34/104 |
| 4,946,393 A | | 8/1990 | Borgstrom et al. | 439/921 |
| 5,082,449 A | * | 1/1992 | Borgsrom et al. | 439/88 |
| 5,215,475 A | | 6/1993 | Stevens | 439/206 |
| 5,907,128 A | | 5/1999 | Lanan et al. | 174/74 R |
| 6,332,785 B1 | * | 12/2001 | Muench, Jr. et al. | 439/88 |
| 6,338,637 B1 | * | 1/2002 | Muench, Jr. et al. | 439/201 |

FOREIGN PATENT DOCUMENTS

| | | |
|---|---|---|
| DE | 1059527 | 6/1959 |
| WO | WO 01/28059 A1 | 4/2001 |

OTHER PUBLICATIONS

Eager, Jr. et al., "Extending Service Life of Installed 15–35 KV Extruded Dielectric Cables," *IEEE Transaction on Power Apparatus and Systems, PAS–103*(8):1997–2005, Aug. 1984.

* cited by examiner

*Primary Examiner*—P. Austin Bradley
*Assistant Examiner*—Ross Gushi
(74) *Attorney, Agent, or Firm*—Christensen O'Connor Johnson Kindness PLLC

(57) ABSTRACT

A cable connector, connector apparatus and method for introducing fluid to a cable. The cable connector, connector apparatus and method configured to form an electrically resistive barrier between components internal to the connector and the environment surrounding the connector after the introduction of the fluid. In one embodiment, a connector comprises a chamber adapted to affix a cable internal to the chamber, wherein the chamber is in fluidic communication with an injection port. The connector further comprises a valve operable to restrict fluid from entering the injection port from the chamber when a fluid source discontinues the introduction of fluid into the injection port. In another embodiment, a method of the present invention involves the application of an insulating material into an injection port of a connector following the application of a dielectric fluid, thereby forming an electrically resistive barrier between components internal to the connector and the external environment.

17 Claims, 4 Drawing Sheets

METHOD AND APPARATUS FOR BLOCKING PATHWAYS BETWEEN A POWER CABLE AND THE ENVIRONMENT

CROSS-REFERENCE TO RELATED APPLICATION

This non-provisional application claims the benefit under 35 U.S.C. §119(e) of U.S. Provisional Application No. 60/251,974, filed on Dec. 6, 2000, and titled "Method and Apparatus for Blocking Pathways Between a Power Cable and the Environment," the subject matter of which is specifically incorporated herein by reference.

FIELD OF THE INVENTION

The present invention relates to a remediation process for the insulation of power cables and, more particularly, to injection of dielectric enhancement component into the power cable.

BACKGROUND OF THE INVENTION

A remediation process for the insulation of high-voltage electrical power cables requires the injection of a remediation fluid into the cables. It is known in the art that remediation fluids which are most effective have viscosities less than 50 centistokes at 25° C. as these fluids must be able to flow through very small interstitial spaces over very long cable lengths and must be of small enough molecular size to diffuse into the cable insulation. In many instances, this injection process takes place while the cable is energized. When the remediation process is performed on energized cables, a class of special cable end terminations is typically used. These terminations are known as injection elbows. Injection elbows are similar to industry standard elbow-type connectors except that special ports have been designed into them to allow for the attachment of an injection plug to the elbows.

After injection of the remediation fluid is complete, the injection plug is withdrawn from the injection port and is replaced with a sealing plug. Between the time that the injection plug is removed, and the sealing plug is installed, the injection port is open, and the energized conductor of the cable is exposed. Because of the remediation fluid's low viscosity it is likely to empty out of the open injection port. Although there is no direct electrical connection between the conductor and the grounded exterior of the cable elbow, there is the danger of an indirect electrical connection being established between the conductor and the grounded exterior of the elbow.

One such indirect pathway may be formed by contaminants that have become entrained in the remediation fluid. Contaminated fluid can be drawn from the injection port as the injection plug is withdrawn or may simply flow out under the force of gravity, thereby creating partial discharging or even a complete conductive pathway to the ground plane.

A second indirect pathway is created by source molecules such as those found in low viscosity remediation fluid, water or other contaminants which may be present in the conductor. Source molecules, also referred to as particles, can ionize or form an aerosol, which may become charged in the high-voltage field. These ionized or charged particles may then accelerate towards the ground plane creating a dynamic and conductive aerial pathway.

These two known conductive pathways, as well as any other conductive pathway established between the conductor and the ground plane, can degrade or destroy the injection elbow. Therefore, a need exists to create a barrier to block the conductive pathway between the conductive portion of the cable and the ground plane to increase the life expectancy of the injection elbow.

SUMMARY OF THE INVENTION

One embodiment of the present invention is directed towards a method and apparatus for creating a barrier after the injection of remediation fluid to block the conductive pathway between the conductive portion of an energized cable and the ground plane. An injection elbow with an injection port is used to introduce remediation fluid into the energized cables. The remediation fluid is introduced into the injection port by way of an injection plug inserted into the injection port. Upon completion of the introduction of the remediation fluid, an insulation material is injected through an injection tube of the injection plug and into the injection port. This insulation material may be any of a variety of dielectric, high-viscosity fluids. The insulation material effectively blocks the conductive pathway between the conductive portion of the cable and the ground plane so as to allow removal of the injection plug without creation of a conductive pathway to allow for the insertion of a permanent plug to block the injection port and protect the injection elbow from degradation.

In another embodiment of the present invention, the injection elbow includes a flap valve located between the injection port and a fluid chamber inside the injection elbow. As fluid is introduced through the injection port, the flap valve is opened either by the fluid pressure, or by an extension on the injection plug, allowing the fluid to fill a chamber in the injection elbow. When the chamber in the fluid elbow is full and introduction of the fluid has ceased, the pressure from inside the chamber forces the flap valve to shut, thus creating a barrier between the conductor and the ground plate. The injection plug can now be removed without exposing the energized conductor which may create a degradation of the injection elbow.

In still another embodiment of the present invention, a physical barrier is incorporated in the injection plug to block the escape of remediation fluid upon discontinuing filling of the chamber of the injection elbow. This embodiment permits leaving behind the injection plug in the injection port thus eliminating a need for a permanent plug. The physical barrier of this embodiment includes a ball valve; however, a variety of gate valves or check valves, actuated manually, electronically, hydraulically, or pneumatically may be used.

In yet another embodiment of the present invention, the injection plug includes a breakable tip having a catch at its end. Upon insertion of the injection tube into the injection port, the breakable tip becomes lodged in the injection port. After discontinuing the introduction of remediation fluid into the chamber, the injection plug is removed causing the breakable tip of the injection tube to remain lodged in the injection port creating a permanent barrier in the injection port, therefore, blocking the conductive pathway between the conductive portion of the cable and the ground plane.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figures 1A, 1B:
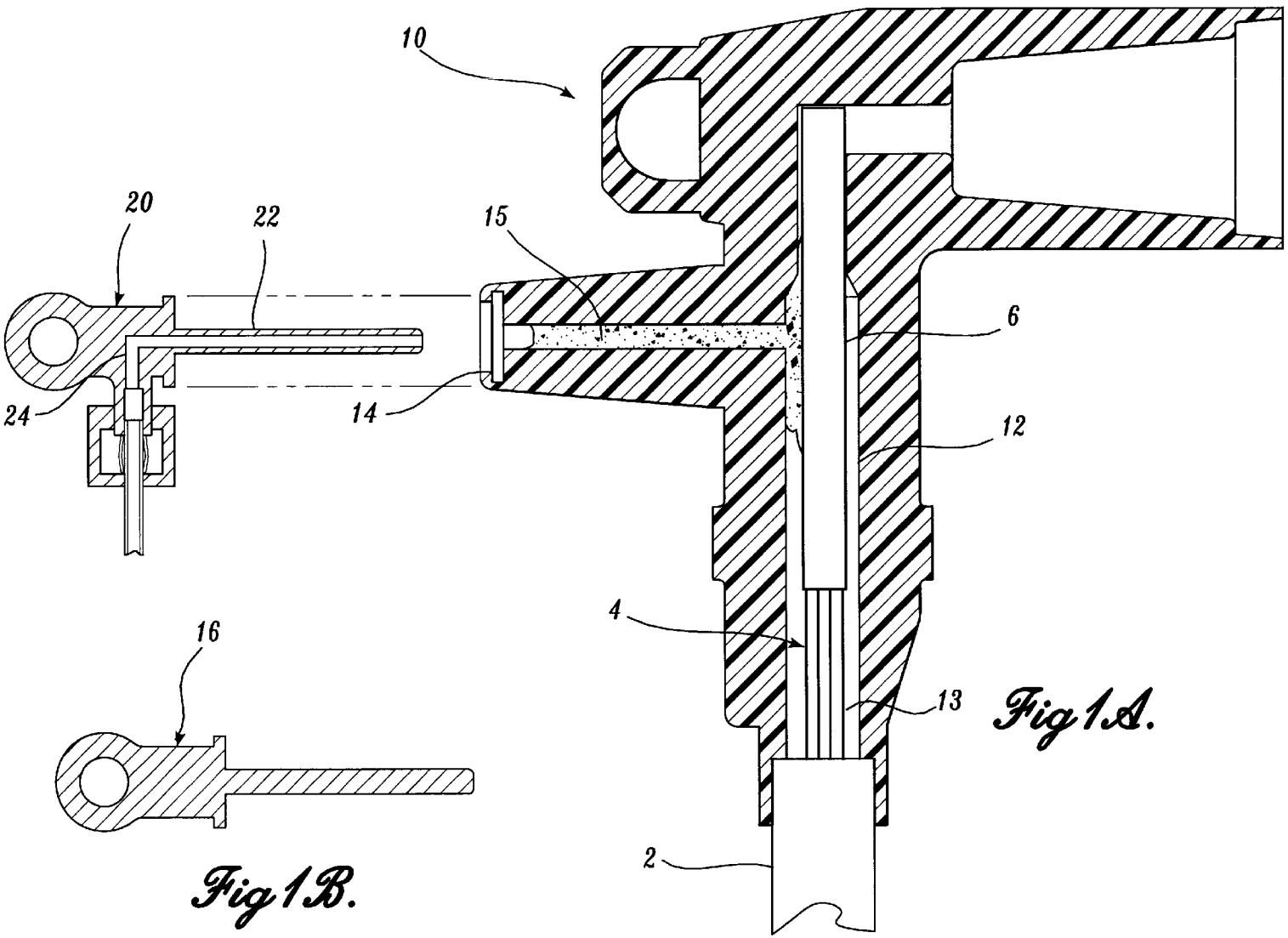
FIGS. 1A and 1B illustrate a cross-sectional side view of an injection elbow formed in accordance with one embodiment of the present invention, showing an injection plug, and a sealing plug.

FIGS. 1A and 1B illustrate an injection elbow 10 formed in accordance with one embodiment of the present invention. Such an injection elbow 10 is adapted to introduce dielectric enhancement fluid into a section of power cable 2, such as a high-voltage electric cable. Typical power cables 2 include a conductive core 4 surrounded by an insulation layer 6. The conductive core 4 includes a plurality of electrically conductive strands 13. Although a plurality of conductive strands 13 is preferred, a cable 2 having a single conductive strand is also within the scope of the present invention. Further, although the injection elbow 10 is illustrated as a load-break connector, other types of connectors, such as tee-body or splice-type connectors which occur at cable junctions, are also within the scope of the present invention.

The elbow 10 includes a fluid chamber 12 and an injection port 14. The injection port 14 permits the introduction of the dielectric enhancement fluid into the cable while the cable is energized. Dielectric enhancement fluid is injected through the injection port 14 and into the fluid chamber 12 by a canal 15, thus allowing fluid to enter the cable insulation through the interstitial spaces between the cable strands.

Still referring to FIG. 1, fluid enters the injection port 14 by way of an injection plug 20. The injection plug 20 includes a conduit 24 and a stem portion 22. In operation, the stem portion 22 is inserted into the injection port 14 to allow for the introduction of the dielectric enhancement fluid into the fluid chamber 12. A permanent plug 16 is sized and shaped for insertion into the injection port 14, thereby sealing the chamber 12 from the environment external to the injection elbow 10. In operation, the permanent plug 16 is inserted into the injection port 14 after the removal of the injection plug 20.

As noted above, it is desirable to minimize the risk of a pathway being formed between the conductive portions 4 and 6, of the cable 2 and the external environment. In that regard, before the injection plug 20 is removed from within the injection elbow 10, an insulation material 15 is injected into the injection port 14. The insulation material 15 forms a barrier to block any pathway between the conductor and ground, including minimizing the risk of the formation of a conductive pathway through the injection port 14. Thereafter, the injection plug 20 is removed from the injection port 14, and the plug 16 is reinserted into the injection port 14 of the injection elbow 10.

Thus, one embodiment of a method for blocking a potential pathway between the conductive core 4 of a cable 2 and a ground plane after removal of the injection plug 20 includes inserting the injection tube 22 of the injection plug 20 into the injection port 14 of the injection elbow 10; introducing a dielectric enhancement fluid into the injection port 14 from the injection plug 20 and into the fluid chamber 12 where it surrounds the conductive core 4 and strands 13; injecting an insulation material 15 through the injection plug 20 and into the injection port 14, whereby the insulation material 15 forms a barrier to block the potential pathway out through the injection port 14; and removing the injection plug 20 and replacing it with the plug 16.

The insulation material 15 is suitably a high dielectric strength, high viscosity material. Because of the material's high viscosity, it remains in place to form a physical barrier between any conductive portion of a cable and the ground plane until the plug 16 can be installed. The insulating fluid 15 can be in the form of a foam, solid, gel, or high viscosity liquid. In one embodiment, the dielectric strength may be greater than 100 volts/mil and the viscosity may be greater than 50 centistokes (cs) at 25C. In this embodiment, the dielectric strength and viscosity should be in a range that allows the insulation material 15 to contain liquid properties. One specific example of an insulating material is Dow Corning 200® fluid. Although the present embodiment uses fluid with a viscosity of 2000 centistoke, any of a variety of high dielectric strength, high viscosity materials may be used.

Figure 2:
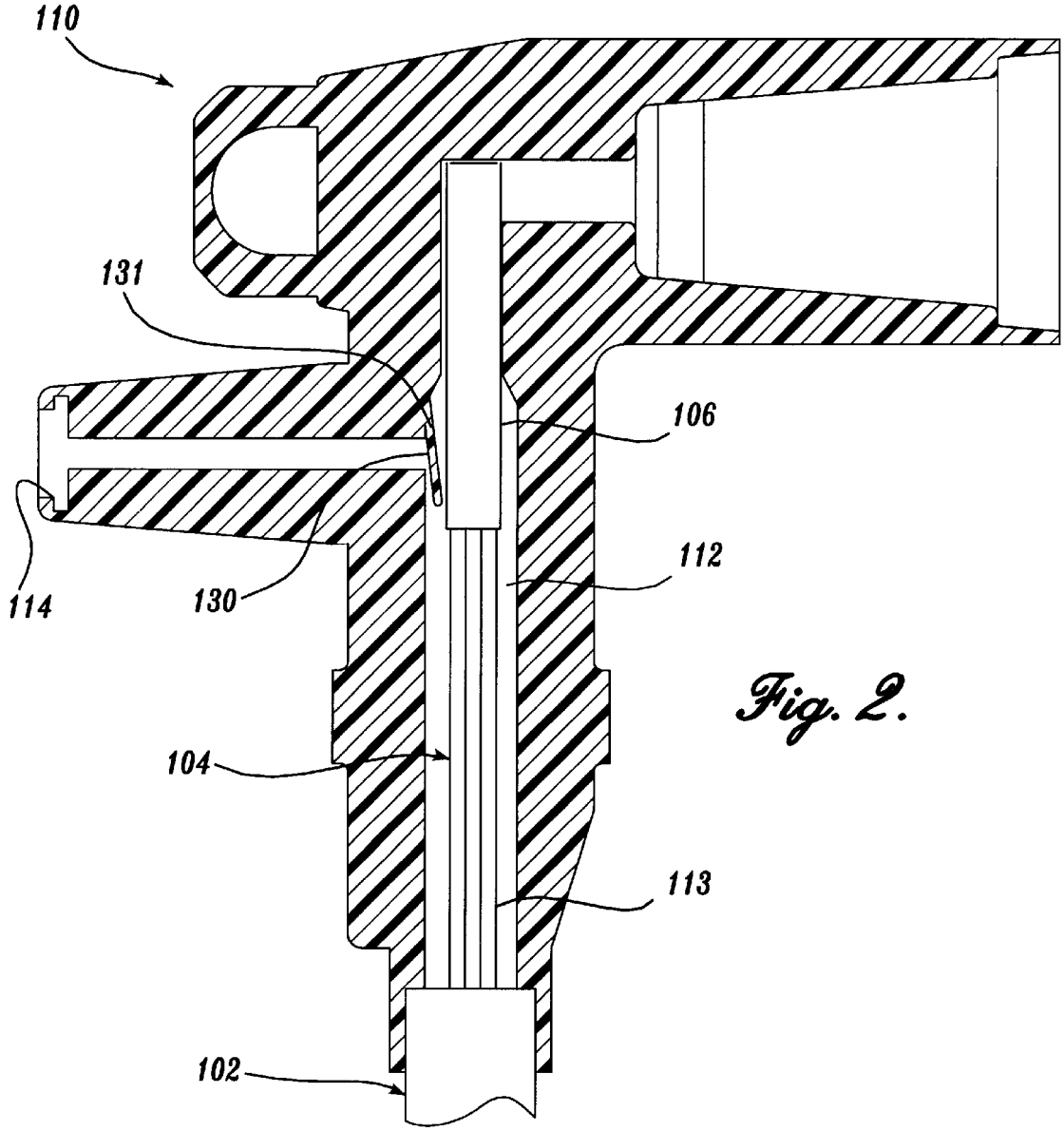
FIG. 2 illustrates a cross-sectional side view of an injection elbow formed in accordance with one embodiment of the present invention, showing a flap valve at the junction of the injection port and the chamber.

FIG. 2 illustrates another embodiment of an injection elbow 110 constructed in accordance with the present invention. The injection elbow 110 is identical in materials and operation to the first embodiment described above with the exception that the injection elbow 110 includes a flap valve 130. In one embodiment, the flap valve 130 is suitably located at the intersection of the injection port 114 and the fluid chamber 112. The flap valve 130 may be integrally connected to the injection elbow 110 by a live hinge, or may be fastened to the injection elbow 110 by a mechanical hinge 131. In one embodiment, the flap valve 130 is normally biased into a closed position. Although the illustrative embodiment of FIG. 2 includes a flap valve 130 that is located near the intersection of the injection port 114 and the fluid chamber 112, the flap valve 130 may be positioned in any location of the injection port 114 and fluid chamber 112 so long as the flap valve 130 is configured to restrict any fluidic communication from the fluid chamber 112 to the injection port 114. For instance, the flap valve 130 may be constructed from a substantially flat member attached to the inner wall of the injection port 114 by the use of a hinge.

As dielectric enhancement fluid is introduced into the injection port 114, the flap valve 130 is forced open by the fluid pressure of the incoming dielectric enhancement fluid, or it is physically opened by an extended length injection fitting, thereby allowing the fluid to enter or exit the chamber 112. When introduction of the fluid has concluded, the flap valve 130 returns to the closed position, thereby creating a physical barrier between the conductive core 104 and the ground plane.

Figure 3:
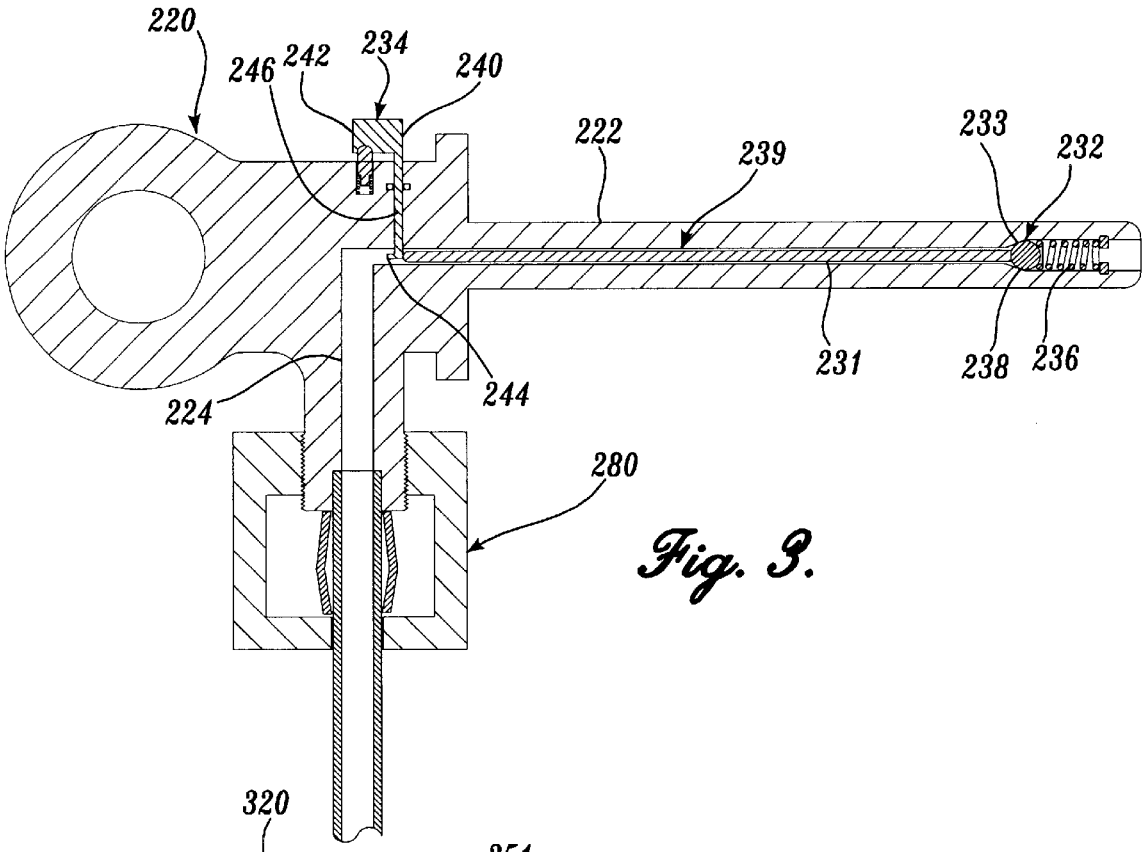
FIG. 3 illustrates a cross-sectional side view of an injection plug formed in accordance with one embodiment of the present invention, showing a ball valve and a ball valve override apparatus.

Referring now to FIG. 3, another embodiment of an injection plug 220 constructed in accordance with the present invention will now be described in greater detail. The injection plug 220 is identical in materials and operation to the injection plug 220 described for the first embodiment with the exception that the injection plug 220 is constructed and configured to remain attached to the injection elbow 10, and includes a plunger assembly 239 and a valve actuator assembly 234. The injection plug 220 is configured to remain attached to the injection elbow 10 after the introduction of dielectric enhancement fluid. As such, it should be apparent that dielectric enhancement fluid is introduced to the injection plug 220 by a removable supply source 280. In operation, the injection plug 220 is accessed in a well known fashion and the supply source 280 is removably coupled to the injection plug 220. After the transfer of dielectric enhancement fluid has been completed, the supply source 280 is decoupled from the injection plug 220. Although a fixed injection plug 220 is suitable for purposes of the current embodiment of the present invention, it should be apparent that other types of injection plugs, such as temporary injection plugs, are also within the scope of the present invention.

The plunger assembly 239 includes a plunger 231 and a spring bias ball valve 232. The plunger 231 is suitably a rod shaped member slidably disposed within the conduit 224 of the stem portion 222. As disposed within the stem portion 222, the plunger extends between the valve actuator assembly 234 and the ball valve 232.

The ball valve 232 includes a spring 236 and a ball 238. The spring 236 biases the ball 238 to a closed and sealed position, wherein the ball 238 is seated within a chamfered portion 233 located in the conduit 224. As assembled, the ball valve 232 is biased into a closed position against the chamfered portion 233 of the conduit 224.

As dielectric enhancement fluid is introduced into the injection plug 220, the fluid pressure causes the ball 238 to overcome the spring force and compress the spring 236, thereby causing the ball valve 232 to open and allow dielectric enhancement fluid to enter the injection port 14 of the injection elbow (10 of FIG. 1). When the flow of dielectric enhancement fluid ceases, the spring 236 biases the ball 238 of the ball valve 232 to the closed position, thereby blocking the escape of dielectric enhancement fluid and any potential pathway that may be created.

The valve actuator assembly 234 is rotatably disposed within the injection plug 220 and allows the ball valve 232 to be manually opened to permit the removal of gas or fluid from the injection elbow 10. The valve actuator assembly 234 includes a paddle mechanism 240 with an upper paddle 242 and a lower paddle 244. The upper paddle 242 is connected to the lower paddle 244 by a shaft 246. The upper paddle 242 is suitably orientated at a 90° angle relative to the lower paddle 244 and is located such that the lower paddle 244 rests against the plunger 231, which is positioned next to the ball 238 of the ball valve 232. As the upper paddle 242 is rotated, the lower paddle 244 is urged against the plunger 231 and the ball 238 of the ball valve 232. As the lower paddle 244 is urged against the ball 238, the ball compresses the spring 236 to open the ball valve 232, thereby allowing fluidic communication from the injection elbow (10 of FIG. 1) into the conduit 224.

In operation, dielectric enhancement fluid is injected through the conduit 224 of the injection plug 220 and into the injection elbow 10. The spring 236 of the ball valve 232 is compressed by utilizing the fluid pressure of the dielectric enhancement fluid, thereby urging the ball 238 against the spring 236. After introduction of the dielectric enhancement fluid into the injection elbow 10 is completed, the ball valve 232 is displaced into the closed position by the spring 236. Finally, the upper paddle 242 is employed anytime the need arises for flow to move in the reverse direction of the valve's bias. The paddle can be operated such that the lower paddle 244 is urged against the ball 238 to open the ball valve 232 and allow for the removal of any air gas or fluids therein as required. At the end of the injection, the connecting tubing 280 is optionally removed, and the injection plug is optionally left in place forming a permanent barrier between the conductor and the ground plane.

Figure 4:
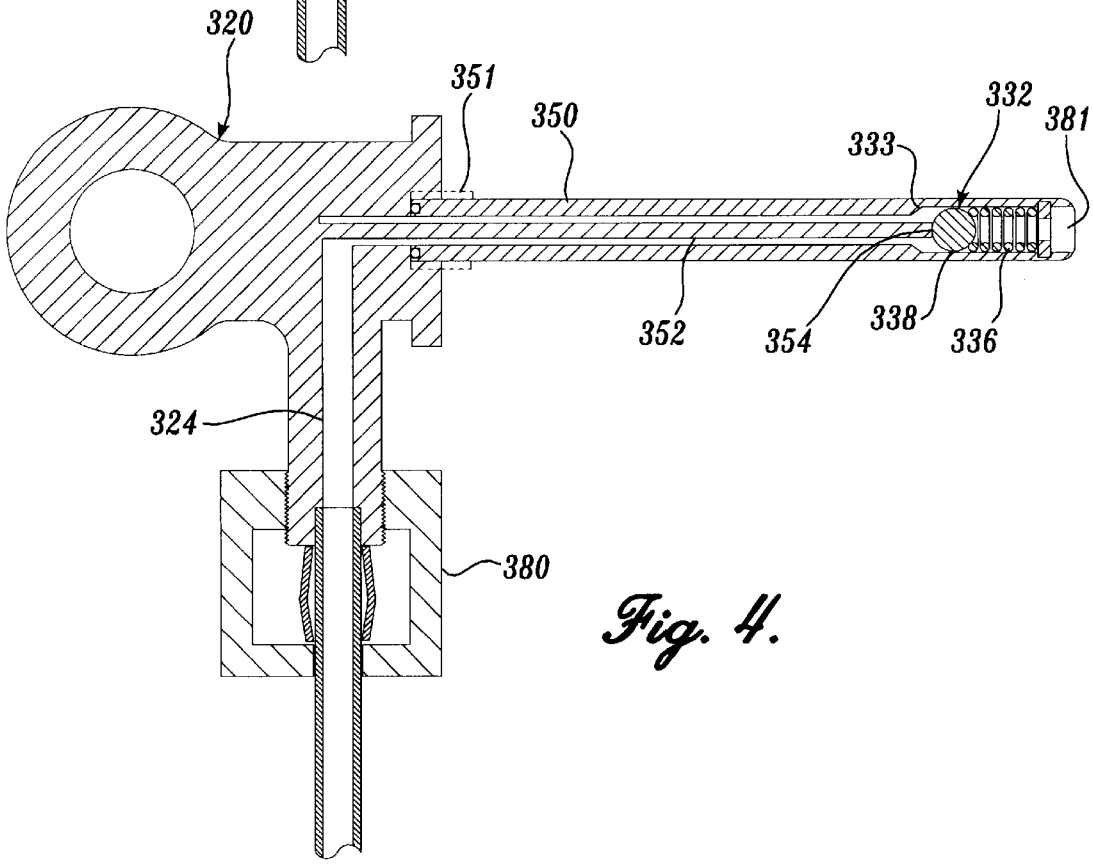
FIG. 4 illustrates a cross-sectional side view of an injection plug with a ball valve formed in accordance with one embodiment of the present invention.

Referring to FIG. 4, an injection plug 320 formed in accordance with another embodiment of the present invention will now be described in greater detail. The injection plug 320 illustrated in FIG. 4 is configured in a manner similar to the embodiment depicted in FIG. 3. For instance, the injection plug 320 includes an elongated nozzle 350, ball valve assembly 332, and a conduit 324. As depicted in FIG. 4, the conduit 324 is configured to allow fluidic communication between a supply source 380 and an opening 381 positioned near the end of the nozzle 350. The injection plug 320 of the present embodiment also includes a spring bias ball valve assembly 332. In one embodiment, the nozzle 350 is selectively fastened to one end of the injection plug 320. As shown in FIG. 4, the nozzle 350 may be attached to the injection plug 320 by the use of a connector 351 such as a latch, threaded connection, or the like. In yet another embodiment, the injection plug 320 comprises a rod 352 that is formed and configured to be slidedly inserted into the nozzle 350 when the nozzle 350 is attached to the injection plunger 320.

The ball valve assembly 332 includes a spring 336 and a ball 338. The spring 336 normally biases the ball 338 against a chamfered portion 333 formed within the nozzle 350, thereby displacing the ball valve assembly 332 into a closed position. In operation, when the injection nozzle is fully threaded, the rod 352 extends through the nozzle 350 and displaces the ball from its seat allowing fluid, gasses or air to move in either direction. Upon completion of the injection process, the nozzle 350 can be detached from the plug 320, thereby withdrawing the inner rod 352 from the nozzle 350. The removal of the inner rod 352 from the nozzle 350 allows the spring 336 to move the ball 338 toward the chamfered portion 333, thereby preventing fluidic communication from the opening 381 into the nozzle 350.

In one embodiment, the nozzle 350 is threadably connected to the body of the injection plug 320 to permit the ball valve assembly 332 to be manually actuated between an open and a closed position by the attachment and detachment of the nozzle 350. In the open position, the nozzle 350 is rotated inward for further engagement with the injection plug 320. With the nozzle 350 in the open position, the ball 338 is urged against the rod 352 thereby compressing the spring 336 and opening the ball valve 332. The embodiments of FIGS. 3 and 4 depict two devices suitable for creating a physical barrier between the conductive core 4 and the ground plane. However, it should be apparent that a variety of gate valves or check valves, actuated manually, electronically, hydraulically, or pneumatically are also within the scope of the described embodiments of the present invention.

Figure 5:
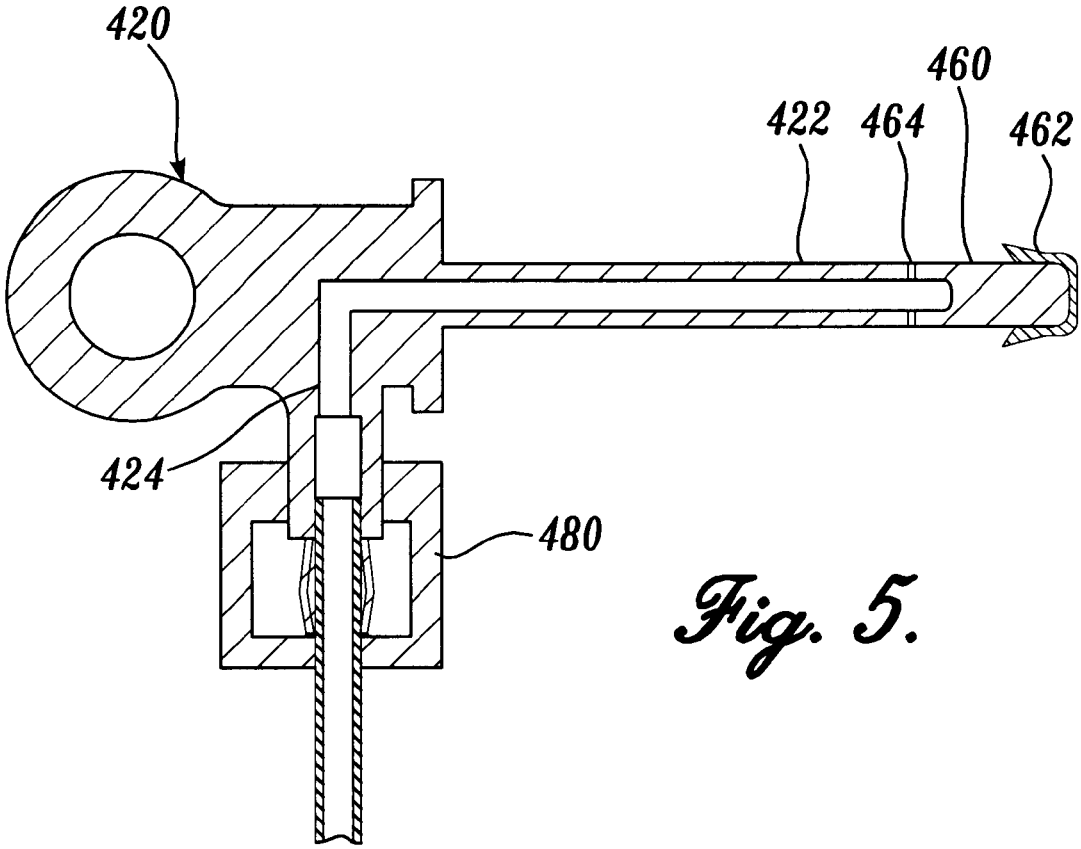
FIG. 5 represents a cross-sectional side view of an injection plug formed in accordance with one embodiment of the present invention, showing an injection tube having a breakable tip and a catch.

Referring now to FIG. 5, another embodiment of an injection plug 420 formed in accordance with the present invention will now be described in greater detail. The injection plug 420 of FIG. 5 is constructed in a manner similar to the injection plug 220 depicted in FIG. 1A. For instance, the injection plug 420 comprises a stem portion 422, a conduit 424 internal to the injection plug 420, and a supply source 480. In addition, the injection plug 420 depicted in FIG. 5 also comprises a cap 462, wherein the cap 462 is positioned at the end of the stem portion 422 and affixed to the stem 422 by a friction type fastener or the like. As described below, the cap 462 is operable to create a barrier in the injection port of an elbow when the injection plug is removed from the injection port. The cap may be made of any flexible material such as rubber or the like. Also shown in FIG. 5, the stem portion 422 also comprises at least one aperture positioned on at least one side of the stem portion 422 for allowing fluidic communication between the conduit 424 and the environment external to the plug 420.

Referring now to FIGS. 1A and 5, the operation of the embodiment shown in FIG. 5 will now be described. In one embodiment, the aperture 464 is positioned near the stem portion 422, such that when the stem portion 422 of the plug 420 is inserted into an injection port 14 of an injection elbow 10, the aperture 464 provides for fluidic communication between the conduit 424 of the plug 420 and the chamber 12 of the elbow 10. Once the stem portion 422 is fully inserted into the injection port 14, a fluid may be injected into the injection port 14 via the conduit 424. Once the injection is complete, the injection plug 420 is withdrawn partially from the injection port 14. In the removal of the injection plug 420, the cap 464 rests against the surface of the fluid chamber 12 and becomes lodged in the injection port 14, thereby preventing fluidic communication between the fluid chamber 12 and the injection port 14.

In another embodiment, the cap 462 is affixed to the end 460 of the stem portion 422 by a threaded connection. In the operation of this embodiment, when the injection plug 420 is withdrawn from the injection port 14, the cap 462 either pulls off or is unthreaded so that the cap 462 remains in the injection port 14 of the elbow 10. Like the above-described embodiment, cap 462 is configured with a flexible material, such that, when the injection plug 420 is removed from the injection port 14, the cap 462 is lodged in the injection port 14, thereby preventing fluidic communication between the fluid chamber 12 and the environment external to the elbow 10.

While the preferred embodiment of the invention has been illustrated and described, it will be appreciated that various changes can be made therein without departing from the scope of the present invention.

The embodiments of the invention in which an exclusive property or privilege is claimed are defined as follows:

1. A cable connector for introducing fluid to a cable affixed in a chamber internal to the cable connector, the cable connector comprising:

an injection port exposed to at least one exterior surface of the cable connector, the injection port having fluidic communication with the chamber internal to the cable connector; and a valve for allowing the passage of fluid from the injection port into the chamber, wherein the valve is operable to allow fluid to enter the chamber internal to the cable connector when the fluid is introduced into the injection port from a fluid source, and wherein the valve is operable to restrict fluid from entering the injection port from the chamber internal to the cable connector when the fluid source discontinues the introduction of fluid into the injection port, wherein the valve is a flap valve connected to the cable connector by a live hinge.

2. A cable connector for introducing fluid to a cable affixed in a chamber internal to the cable connector, the cable connector comprising:

an injection port exposed to at least one exterior surface of the cable connector, the injection port having fluidic communication with the chamber internal to the cable connector; and a valve for allowing the passage of fluid from the injection port into the chamber, wherein the valve is operable to allow fluid to enter the chamber internal to the cable connector when the fluid is introduced into the injection port from a fluid source, and wherein the valve is operable to restrict fluid from entering the injection port from the chamber internal to the cable connector when the fluid source discontinues the introduction of fluid into the injection port, wherein the flap valve is biased into a closed position.

3. A cable connector for introducing fluid to a cable affixed in a chamber internal to the cable connector, the cable connector comprising:

an injection port exposed to at least one exterior surface of the cable connector, the injection port having fluidic communication with the chamber internal to the cable connector; and a valve for allowing the passage of fluid from the injection port into the chamber, wherein the valve is operable to allow fluid to enter the chamber internal to the cable connector when the fluid is introduced into the injection port from a fluid source, and wherein the valve is operable to restrict fluid from entering the injection port from the chamber internal to the cable connector when the fluid source discontinues the introduction of fluid into the injection port, wherein the valve is a flap valve connected to the cable connector by a mechanical hinge.

4. The cable connector of claim 3, wherein the flap valve is positioned at the intersection of the chamber and the injection port, and wherein the flap valve is biased into a closed position.

5. An apparatus for introducing fluid to a cable, the apparatus comprising:

a cable connector having an injection port exposed to at least one exterior surface of the cable connector and a chamber internal to the cable connector, wherein the chamber is adapted for affixing a cable internal to the chamber, wherein the injection port and the chamber are configured to provide fluidic communication between the chamber and injection port; and a plug adapted for insertion into the injection port of the cable connector, wherein the plug provides fluidic communication between a conduit internal to the plug and the chamber when the plug is inserted into the injection port, wherein the plug includes a valve configured to restrict fluidic communication between the conduit and the chamber if the fluidic pressure in the chamber is greater than or equal to the fluidic pressure in the conduit.

6. The apparatus of claim 5, wherein the valve comprises:

a ball positioned in a chamfered portion of the conduit, wherein the ball is movable relative to the side of the chamfered portion;

a spring adapted to bias the ball against the side of the chamfered portion of the conduit, thereby restricting fluidic communication between the conduit and the chamber, and wherein the ball and spring are configured to allow fluidic communication from the conduit to the chamber when fluid is supplied into the conduit from a supply source.

7. The apparatus of claim 6, further comprising an actuator for biasing the ball away from the side of the chamfered portion of the conduit, thereby allowing fluidic communication between the conduit and the chamber.

8. The apparatus of claim 6, wherein the actuator is a manually operated actuator.

9. An apparatus for introducing fluid to a cable, the apparatus comprising:

a connector having a port means and a chamber means, wherein the chamber means is adapted for affixing a cable internal to the chamber, wherein the port means and the chamber means are configured to provide fluidic communication between the chamber means and the port means; and a plug means for providing fluidic communication between a fluid source and the chamber means, wherein the plug means is configured to restrict fluidic communication between the conduit and the chamber if the fluidic pressure in the chamber is greater than or equal to the fluidic pressure in the conduit.

10. An apparatus for introducing fluid to a cable, the apparatus comprising:

a cable connector having an injection port exposed to at least one exterior surface of the cable connector and a chamber internal to the cable connector, wherein the chamber is adapted for affixing a cable internal to the chamber, wherein the injection port and the chamber are configured to provide fluidic communication between the chamber and injection port; and a plug having a stem adapted for insertion into the injection port of the cable connector, wherein the stem is selectively affixed to the plug by a detachable fastener, the stem arranged such that a conduit in the stem is in fluidic communication with a conduit internal to the plug, and wherein the conduit in the stem is in fluidic communication with the chamber of the cable connector, the plug further comprising a rod configured to extend through the conduit in the stem, wherein the rod actuates a valve in the conduit in the stem to an open position, thereby allowing fluid to pass from the conduit in the stem to the chamber, and wherein the valve restricts the fluidic communication between the conduit of the stem and chamber when the stem is selectively detached from the plug.

11. The apparatus of claim 10, wherein the rod is configured to bias the valve in the conduit of the stem to allow fluidic communication between the conduit of the stem and the chamber when the stem is selectively affixed to the plug.

12. The apparatus of claim 10, wherein the detachable fastener is a threaded fastener.

13. The apparatus of claim 10, wherein the valve comprises:

a ball positioned in a chamfered portion of the conduit of the stem;

a spring adapted to bias the ball against the side of the chamfered portion of the conduit, thereby restricting fluidic communication between the conduit in the stem and the chamber when the stem is detached from the plug.

14. An apparatus for introducing fluid to a cable, the apparatus comprising:

a cable connector having an injection port exposed to at least one exterior surface of the cable connector and a chamber internal to the cable connector, wherein the chamber is adapted for affixing a cable internal to the chamber, wherein the injection port and the chamber are configured to provide fluidic communication between the chamber and injection port; and a plug adapted for insertion into the injection port of the cable connector, wherein the plug provides fluidic communication between a conduit internal to the plug and the chamber of the cable connector when the plug is inserted into the injection port, wherein the plug further comprises a flexible cap operable to lodge into the injection port when the plug is removed from the injection port, thereby restricting fluid flow through the injection port.

15. A method of introducing insulation material into a connector having an injection port and a chamber, wherein the chamber is formed to affix at least one cable internal to the chamber, and wherein the connector is configured to provide fluidic communication between the injection port and the chamber, the method comprising:

inserting an injection plug into the injection port of the connector; and injecting the insulation material into the injection plug, thereby filling at least a portion of the injection port with the insulation material, wherein the injection of the insulation material creates an electrically resistive barrier between the chamber and a surface area external to the connector, wherein the insulation material is made from a high viscosity liquid.

16. A method of introducing insulation material into a connector having an injection port and a chamber, wherein the chamber is formed to affix at least one cable internal to the chamber, and wherein the connector is configured to provide fluidic communication between the injection port and the chamber, the method comprising:

inserting an injection plug into the injection port of the connector; and injecting the insulation material into the injection plug, thereby filling at least a portion of the injection port with the insulation material, wherein the injection of the insulation material creates an electrically resistive barrier between the chamber and a surface area external to the connector, wherein the insulation material is a dimethylsiloxane polymer with a viscosity greater than 50 cp at 25° C. and a dielectric breakdown strength greater than 100 volts/mil.

17. A method of introducing a fluid into a connector having an injection port and a chamber, wherein the chamber is formed to affix at least one cable internal to the chamber, and wherein the connector is configured to provide fluidic communication between the injection port and the chamber, the method comprising:

inserting an injection plug into the injection port of the connector;

injecting a fluid into the injection plug, thereby filling at least a portion of the chamber with the fluid; and injecting an insulation material into the injection plug, thereby filling at least a portion of the injection port with the insulation material, wherein the injection of the insulation material creates an electrically resistive barrier between the injected fluid and a surface area external to the connector.

* * * * *